US009289344B2

(12) United States Patent
Pi

(10) Patent No.: US 9,289,344 B2
(45) Date of Patent: Mar. 22, 2016

(54) MEDICAL SUPPORT PILLOW FOR FACILITATING TRACHEAL INTUBATION ON OBESE PATIENT

(76) Inventor: Kaiduan Pi, Coram, NY (US)

( * ) Notice: Subject to any disclaimer, the term of this patent is extended or adjusted under 35 U.S.C. 154(b) by 0 days.

(21) Appl. No.: 13/487,094

(22) Filed: Jun. 1, 2012

(65) Prior Publication Data

US 2012/0266894 A1 Oct. 25, 2012

Related U.S. Application Data

(63) Continuation-in-part of application No. 13/455,196, filed on Apr. 25, 2012, now abandoned.

(60) Provisional application No. 61/478,550, filed on Apr. 25, 2011.

(51) Int. Cl.
*A61G 13/12* (2006.01)

(52) U.S. Cl.
CPC ..... *A61G 13/121* (2013.01); *A61G 13/1215* (2013.01); *A61G 13/1235* (2013.01); *A61G 13/1285* (2013.01); *A61G 2200/16* (2013.01)

(58) Field of Classification Search
CPC ..... A61F 5/56; A61G 13/12; A61G 13/121; A61G 13/1215; A61G 13/124; A61G 7/065; A61G 7/07; A61G 7/072; A47G 9/10
USPC ..... 128/845; 5/636, 637, 639, 640, 630, 5/632, 633, 638, 641–645
See application file for complete search history.

(56) References Cited

U.S. PATENT DOCUMENTS

| | | | | |
|---|---|---|---|---|
| 1,904,039 | A * | 4/1933 | Bruder | 606/240 |
| 5,730,152 | A * | 3/1998 | Esser | 128/845 |
| 6,321,403 | B1 * | 11/2001 | Matthews | 5/655 |
| 6,446,288 | B1 * | 9/2002 | Pi | 5/636 |
| 6,622,727 | B2 * | 9/2003 | Perry | 128/845 |
| 7,665,165 | B2 * | 2/2010 | Maganov | 5/419 |
| 8,006,335 | B1 * | 8/2011 | Andermann | 5/638 |

OTHER PUBLICATIONS

Barash et al, Clinical Anesthesia Fourth Edition, 2001, p. 607, Lippincott Williams & Wilkins.
Miller, Miller's Anesthesia Sixth Edition vol. 1, 2004, p. 1032, Churchill Livingstone.

* cited by examiner

*Primary Examiner* — Nicholas Woodall
*Assistant Examiner* — Raymond E Harris
(74) *Attorney, Agent, or Firm* — Raymond A. Nuzzo

(57) ABSTRACT

An apparatus for facilitating tracheal intubation on an obese patient has a base section (1), a head section (11) attached to the base section (1) and a pad (2) removably positioned on the head section (11). The base section (1) receives a portion of an obese patient's back. Separate arm rests (3, 4) are positioned on both left and right sides of the base section (1). The base section (1) has an indentation (16) for receiving the occiput of a patient's head. The pad (2) has an indentation (115) for receiving the occiput of a patient's head and which is aligned with indentation (16) when pad member (2) is positioned on the head section (11). The apparatus raises the obese patient's head and neck above the patient's chest and positions the patent's head in a stable, extended position to allow easy ventilation and intubation.

1 Claim, 17 Drawing Sheets

MEDICAL SUPPORT PILLOW FOR FACILITATING TRACHEAL INTUBATION ON OBESE PATIENT

The current application is a Continuation in-part of, and claims priority to U.S. application Ser. No. 13/455,196 entitled "Medical Support Pillow for Facilitating Tracheal Intubation on Obese Patient" filed on Apr. 25, 2012, which claims priority to U.S. Provisional Application Ser. No. 61/478,550 filed on Apr. 25, 2011.

FIELD OF THE INVENTION

The present invention relates generally to an apparatus which raises an obese patient's head and neck above the thorax and creates an ideal position for ventilation and intubation. The ideal position fully extends the obese patient's neck in backward so that easy ventilation and intubation can be performed.

BACKGROUND OF THE INVENTION

The present invention is an improvement of the U.S. Pat. No. 6,446,288, and the present invention includes additional components and specifically designs for obese patients. According to the National Center for Health, obesity is increasing greatly in the United States. 63% of Americans are overweight with a BMI (body mass index) over 25.0; 31% are obese with a BMI of over 30.0; 3.8 million people have a body weight over 300 pounds. As the population of obese people increase, the amount of surgeries related to the obese population are also increasing. According to the text book of Clinical Anesthesia published in 2001, the obese patient may need further positioning to move the mass of the chest away from the plane across which the laryngoscope handle will sweep as it is manipulated into the mouth. This may require placing a wedge-shaped lift (e.g., blankets, pillows) under the scapula, shoulders, and nape of neck, raising the head and the neck above the thorax and providing a grade to allow gravity to take the mass away from the airway. Positioning the obese patient with a roll under the scapulas and an occipital rest and asking the obese patient to fully extend the atlanto-occipital joint before induction may facilitate awake or conventional laryngoscopy and intubation as presented in Miller's Anesthesia published in 2004. The present invention effectively raises the obese patient's head and neck above the thorax and maintains the patient's head and neck in a stable extended position, which is also known as the sniff position. The present invention facilitates mask ventilation, direct laryngoscopy, insertion of laryngeal mask and fiberoptic bronchoscope-aided intubation.

Accordingly, the present invention is directed to an apparatus for facilitating tracheal intubation on an obese patient, comprising a base section (1) comprising a bottom portion having a bottom surface (15) and an upper portion (12). The upper portion (12) comprises an inclined surface (124) for receiving an upper back of a patient. The base section (1) further comprises a lower, front end having a front surface (123) and an upper, rear end (13) having a vertical rear wall. The lower, front end has a first height and the upper, rear end (13) has a second height that is greater than the first height so as to provide the incline of the inclined surface (124). The base section (1) further comprise a pair of sidewalls (121, 122) that are parallel to each other and perpendicular to the vertical rear wall of the upper, rear end (13). The upper portion (12) has an upper, perimetrical boundary at the upper, rear end (13) that extends between the pair of sidewalls (121, 122). The upper portion (12) further comprises an indentation (16) in the inclined surface (124) which bisects the upper, perimetrical boundary and is centrally located between the pair of sidewalls (121, 122). The indentation (16) is sized and shaped to receive the back portion of a patient's neck. The apparatus further comprises a head section (11) that is attached to the vertical rear wall of the upper, rear end (13). The head section (11) comprises an upper end that is adjacent to the perimetrical boundary of the upper portion (12) and which has a third height that is equal to the second height of the upper, rear end (13) of base section (1). The head section (11) further comprises a lower end that has a fourth height that is less than the third height. The fourth height of the lower end of the head section (11) is greater than the first height of the lower, front end of the base section (1). The head section (11) further comprises a pair of sidewalls (111, 112) and a rear wall (113). The rear wall (113) and the pair of sidewalls (111, 112) are vertically oriented and sidewalls (111, 112) are substantially perpendicular to the rear wall (113). The head section (11) further comprises a downwardly sloping contour (114) that extends between the upper end of the head section (11) and the lower end of the head section (11). The indentation (16) extends beyond the perimetrical boundary of upper portion (12) of base section (1) and the upper end of the head section (11) such that the indentation (16) is contiguous with the downwardly sloping contour (114). The head section (11) further comprises a cavity (115) that is centrally located in the downwardly sloping contour (114). The cavity (115) is substantially aligned with indentation (16) and has a first predetermined diameter that allows the occiput of a patient's head to be positioned within the cavity (115). The base section (1) has a first width measured from sidewall to sidewall and the head section (11) has a second width measured from the sidewall to the sidewall. The first width is greater than the second width. The apparatus further comprises a pad member (2) that is removably and adjustably positioned upon the downwardly sloping contour (114) of the head section (11). The pad member (2) comprises a top side (21), a pair of sidewalls (22, 23) and a curved bottom side (25) for contacting the downwardly sloping contour (114). The curved bottom side (25) has a curvature that corresponds to the curvature of the downwardly sloping contour (114). The pad member (2) further comprises a centrally located cavity (26) that is sized to receive the occiput of a patient's head. The position of the pad member (2) upon the downwardly sloping contour (114) may be adjusted to different positions so that the top side (21) of the pad member (2) is angulated to different desired degrees of angulation. The apparatus further comprises a pair of arm rests (3, 4) that are separate from the base section (1) and head section (11) such that the arm rests (3, 4) may be moved to different angular positions with respect to the base section (1) and head section (11). Each arm rest (3, 4) is located on a corresponding side of the base section (1). Each arm rest (3, 4) comprises a relatively shallow arm channel (41), a first pair of sidewalls (42), a second pair of sidewalls (43), a top surface (44), a bottom surface (45), a first end having a fifth height and a second end that has a sixth height wherein the sixth height is less than the fifth height so as to provide an incline in each arm rest (3, 4). Each arm channel (41) is centrally positioned in top surface (44) between the second pair of sidewalls (43).

DETAILED DESCRIPTIONS OF THE INVENTION

All illustrations of the drawings are for the purpose of describing selected versions of the present invention and are not intended to limit the scope of the present invention.

Figure 1:
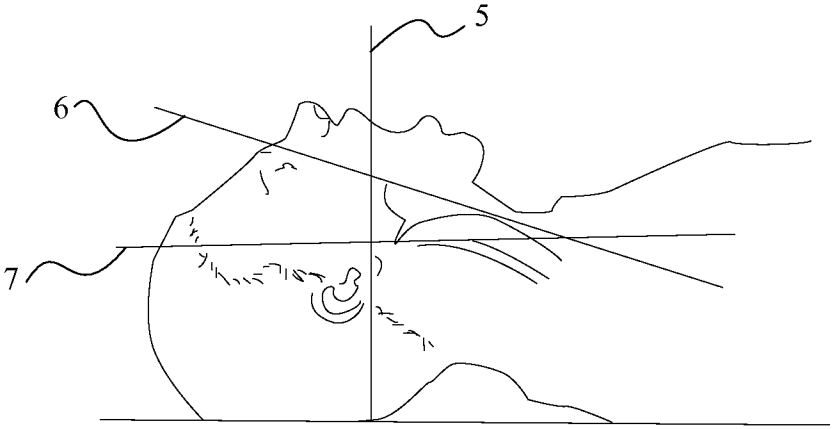
FIG. 1 PRIOR ART
FIG. 1 is a side view illustrating the required first head position for intubation.
Figure 2:
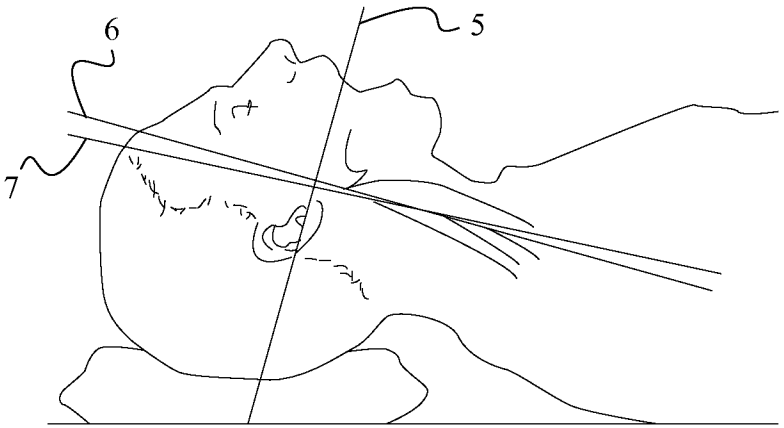
FIG. 2 PRIOR ART
FIG. 2 is a side view illustrating the required second head position for intubation.
Figure 3:
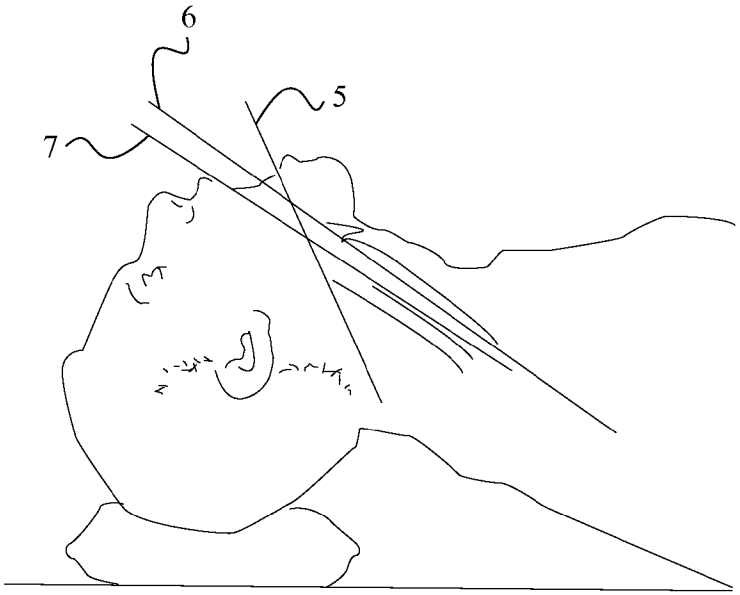
FIG. 3 PRIOR ART
FIG. 3 is a side view illustrating the required third head position for intubation.

Proper alignment of the airway between the mouth and the rima glottidis allows easy intubation of the patients. In order to achieve successful direct laryngoscopy in the patients, an oral axis 5, a pharyngeal axis 6, and a laryngeal axis 7 must be aligned. In reference to FIG. 1, when a patient is laid on a surgical bed, the oral axis 5, the pharyngeal axis 6, and the laryngeal axis 7 are not aligned due to the forward positioning of the head. As shown in FIG. 2 and FIG. 3, a pad or pillow is placed under the patient's head so that the pharyngeal axis 6 and the laryngeal axis 7 can be aligned. Then the patient's head is extended at the atlanto-occipital joint so that the oral axis 5 aligns with the pharyngeal axis 6 and the laryngeal axis 7, as they may provide the shortest distance from the mouth to the rima glottidis. Since the patient is in an unconscious stage, the extension of the patient's head to the sniff position can be difficult to achieved. In order to stabilize the patient's head at the sniff position, extra precautions must be implemented, such as placing additional padding under the neck or holding the head in the extended position with the help of an assistant. The direct laryngoscopy of an obese patient is much harder to perform compared to the direct laryngoscopy of a regular patient due to the obese patient's challenging airway anatomy. The present invention effectively raises the head and neck of the obese patient above the obese patient's thorax and provides a inclining grade. The inclining grade allows gravity to eliminate the mass of the chest away from the airway and the obese patient's upper abdomen away from the diaphragm. In addition, the bilateral chest wall of the obese patient drops down and the upper airway becomes more isolated. In addition to elevation of the head, neck and upper chest, the present invention also creates the sniff position in which the obese patient's head is fully extended at the Atlanta-occipital joint and the airway is maximally opened.

Figure 4:
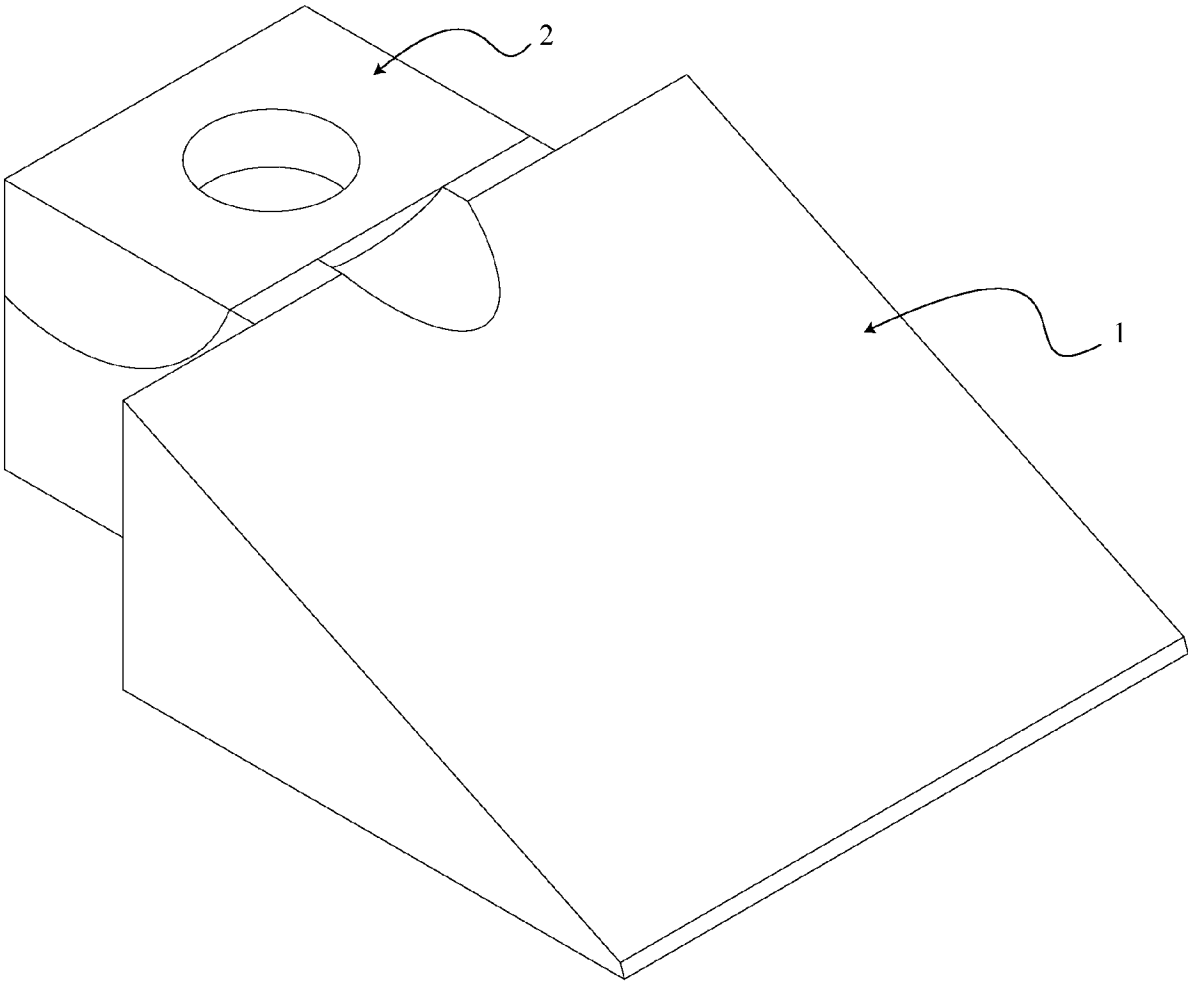
FIG. 4 is a perspective view of the base section and upper pad.

The present invention effortlessly aligns the oral axis 5, the pharyngeal axis 6, and the laryngeal axis 7 of the obese patient so that the intubation can be take placed in a safe manner. In reference to FIG. 4 and FIG. 5, the present invention comprises a base section 1, an upper pad 2, a left arm rest 3, and a right arm rest 4. The base section 1 comprises a head section 11, a back section 12, a bottom surface 15, and an indentation 16. The head section 11 is positioned above the back section 12, and the bottom surface 15 is positioned below the head section 11 and back section 12. The indentation 16 is centrally positioned in between the head section 11 and the back section 12.

Figure 5:
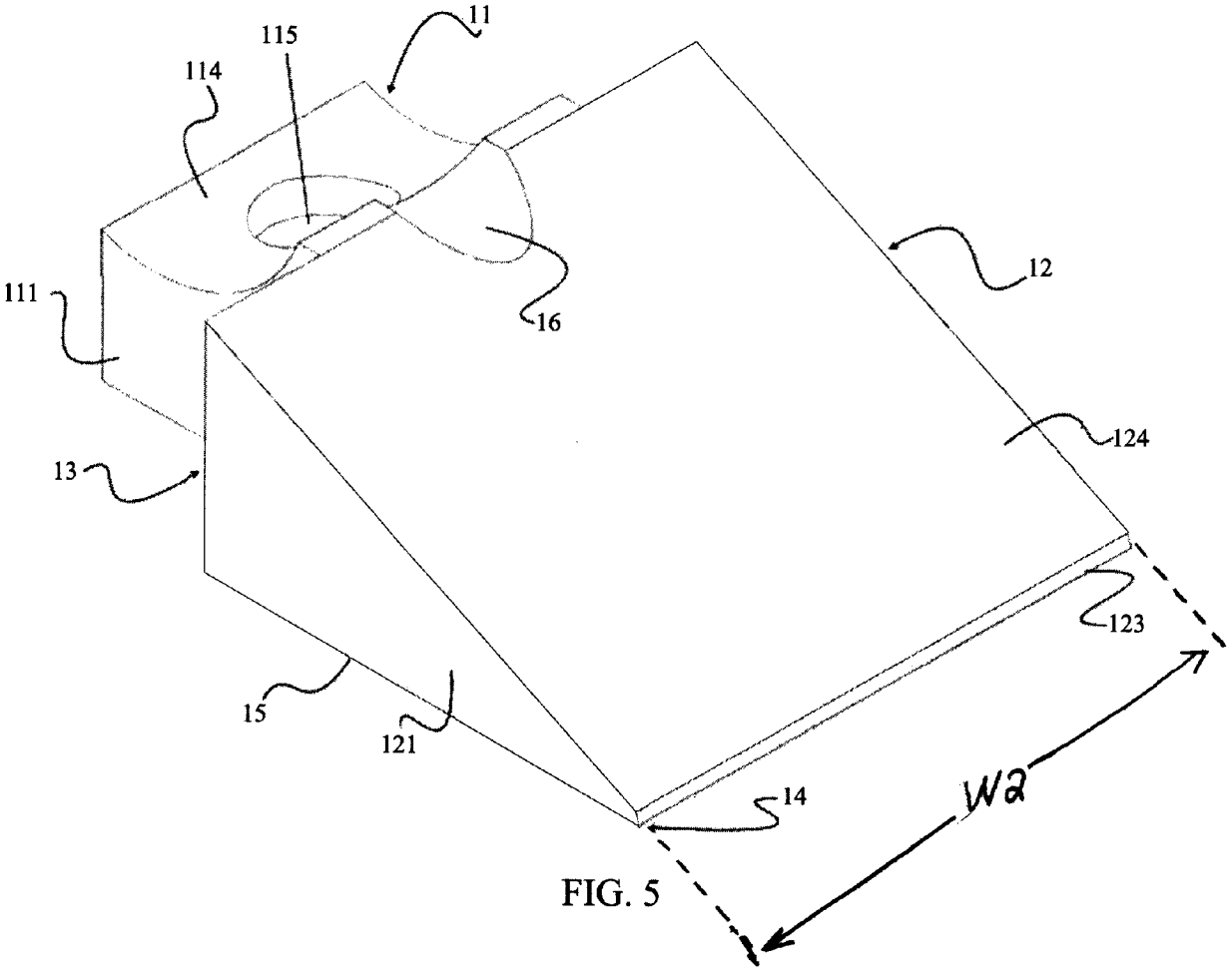
FIG. 5 is a perspective view of the base section.
Figure 6:
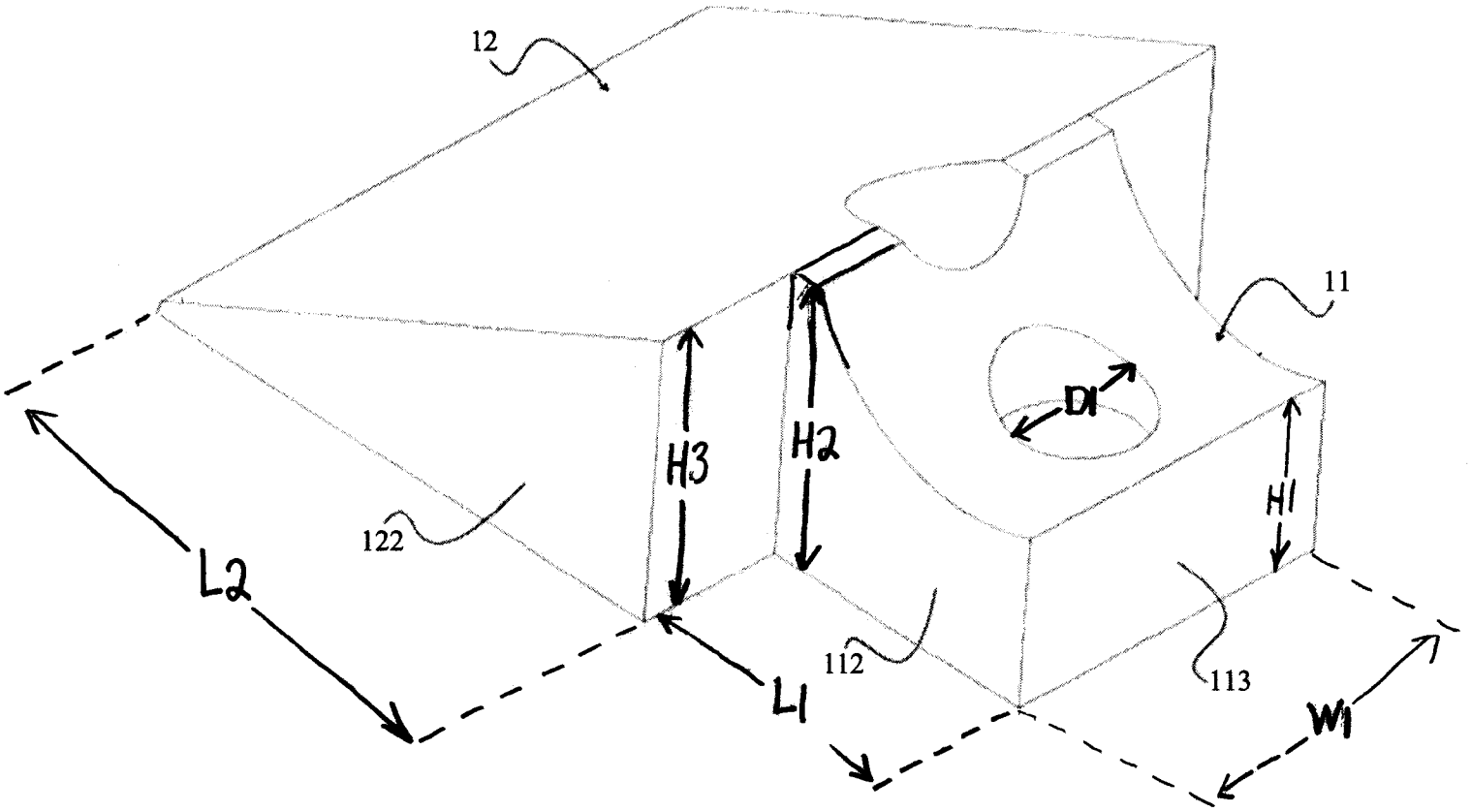
FIG. 6 is a back perspective view of the base section.

In reference to FIG. 5 and FIG. 6, the head section 11 comprises a first side surface 111, a second side surface 112, a back surface 113, a concave surface 114, and a base cavity 115. The first side surface 111 and the second side surface 112 are oppositely positioned from each other. The bottom surface 15 is perpendicularly positioned with the first side surface 111 and the second side surface 112 from below. The first side surface 111 and the second side surface 112 have an upper segment and a lower segment, where the upper segment's height is higher than the lower segment's height. The upper segment is positioned with the back section 12, and the back surface 113 is perpendicularly positioned with the lower segment. The concave surface 114 is positioned with the first side surface 111 and the second side surface 112, but the concave surface 114 is oppositely positioned from the bottom surface 15. The base cavity 115 is centrally positioned on the concave surface 114. The head section 11 has a width W1 and a length L1. In a preferred embodiment, the width W1 is about 20 centimeters and the length L1 is about 24 centimeters. The lower segment has a height H1 and the upper segment has a height H2. In the preferred embodiment, the height H1 is about 12 centimeters and the height H2 is about 20 centimeters. The base cavity 115 has a diameter D1, and in the preferred embodiment, the diameter D1 is about 10 centimeters.

The back section 12 comprises a third side surface 121, a fourth side surface 122, a front surface 123, and an inclined surface 124. The third side surface 121 and the fourth side surface 122 are oppositely positioned from each other. The bottom surface 15 is perpendicularly positioned with the third side surface 121 and the fourth side surface 122 from below. The third side surface 121 and the fourth side surface 122 have an upper end portion 13 and a lower end portion 14, where the upper end portion's 13 height is higher than the lower end portion's 14 height. The upper end portion 13 is positioned with the head section 11, and the front surface 123 is angularly positioned with the lower end portion 14. The inclined surface 124 is positioned with the first side surface 111 and the second side surface 112, and the inclined surface 124 is oppositely positioned from the bottom surface 15. The inclined surface 124 extends from the lower end portion 14 to upper end portion 13. The back section 12 has a width W2 and a length L2. In the preferred embodiment, the width W2 is about 40 centimeters and the length L2 is about 45 centimeters. The upper end portion 13 has a height H3, and the front surface 123 has a width W3. The length of the front surface 123 is same as the length L2 ,and the height H3 is also equal to the height H2. In the preferred embodiment, the height H3 is about 20 centimeters and the width W3 is about 1 centimeter.

Figure 7:
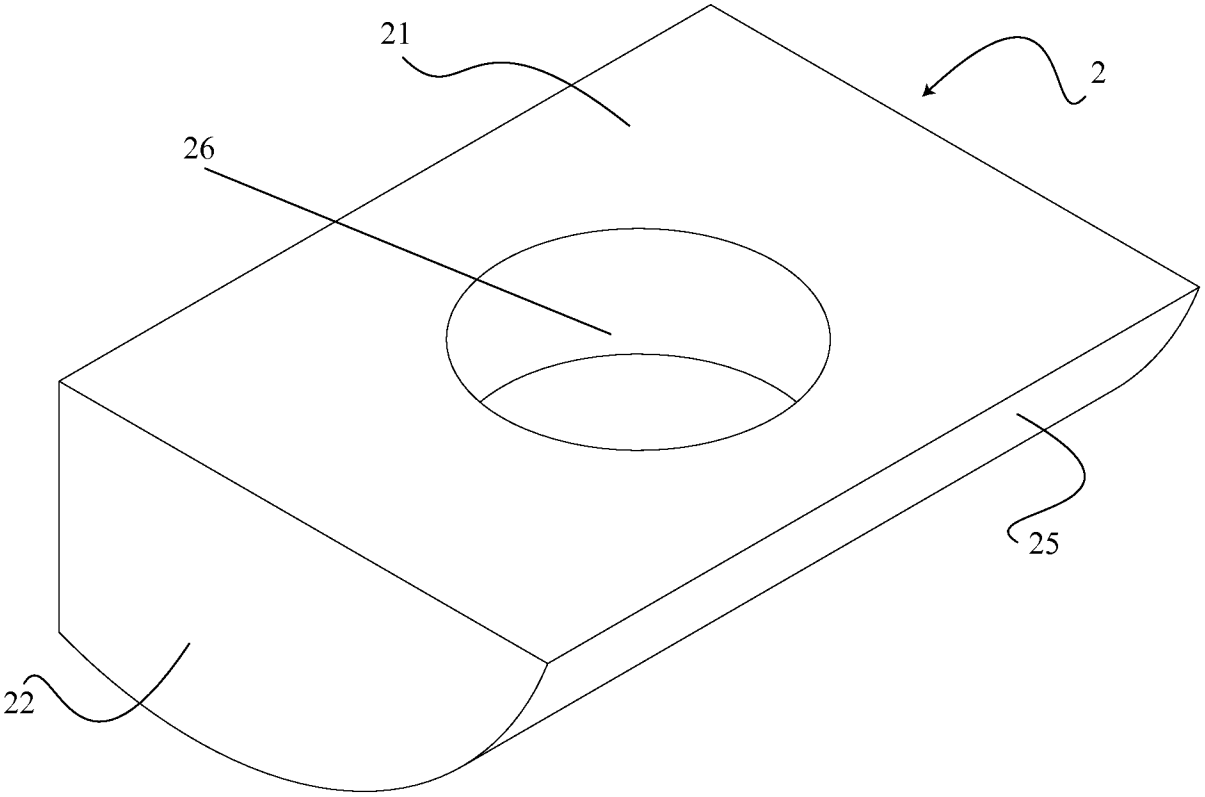
FIG. 7 is a perspective view of the upper pad.
Figure 8:
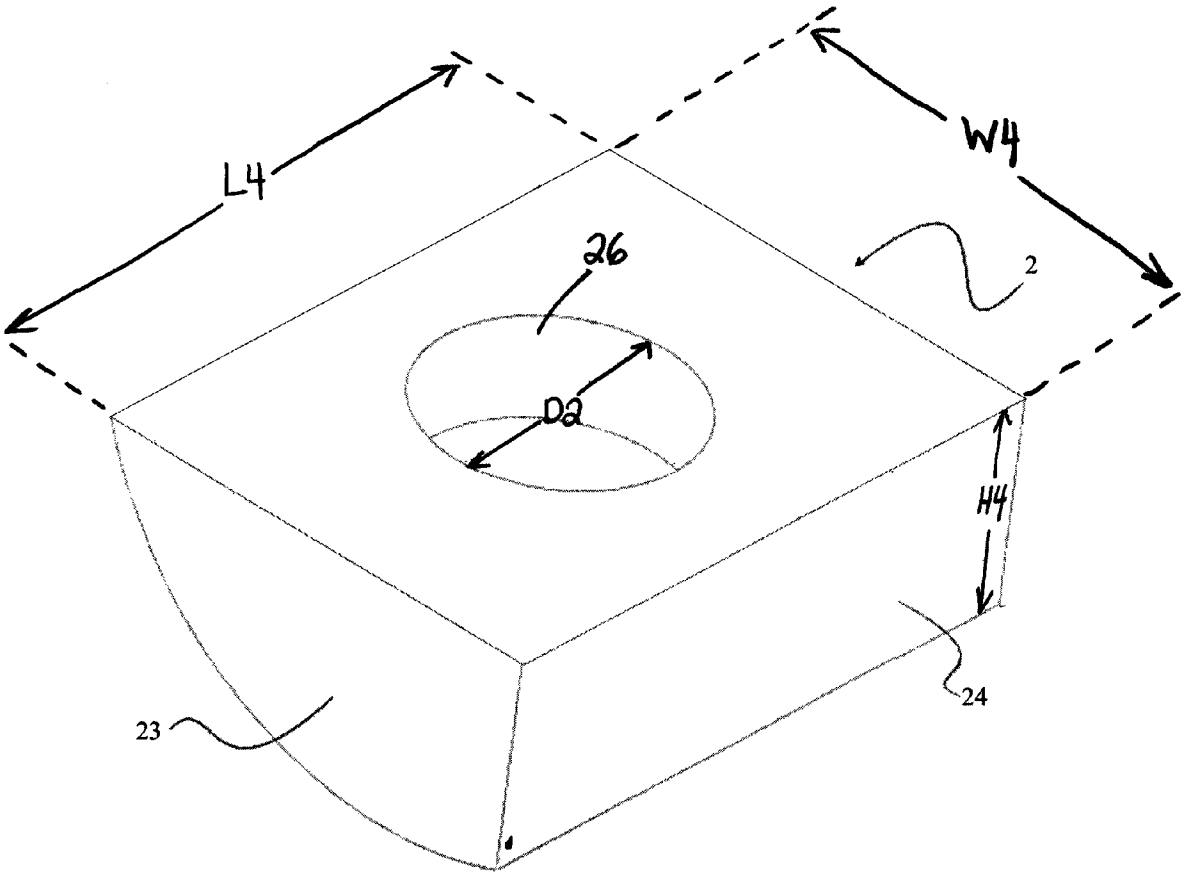
FIG. 8 is a back perspective view of the upper pad.

In reference to FIG. 7 and FIG. 8, the upper pad 2 comprises a top panel 21, a first side panel 22, a second side panel 23, a back panel 24, a concave panel 25, and an upper pad cavity 26. The first side panel 22 and the second side panel 23 are oppositely positioned from each other. A horizontal portion of the first side panel 22 and the second side panel 23 is perpendicularly positioned with the top panel 21, and a vertical portion of the first side panel 22 and the second side panel 23 is positioned with the back panel 24. The back panel 24 is also perpendicularly positioned with the top panel 21. The concave panel 25 is positioned under the first side panel 22 and the second side panel 23, and extends from the top panel 21 to the back panel 24. The upper pad cavity 26 is centrally positioned on the top panel 21 and has a diameter D2 which is equal to the diameter D1. The upper pad 2 has a length L4, a width W4, and a height H4. In the preferred embodiment, the length L4 is about 24 centimeters, the width W4 is about 18 centimeters, and the height H4 is about 8 centimeters. The height H4 is not limited to 8 centimeters and can be adjusted to different sizes. The concave panel 25 is concentrically positioned with the concave surface 114, and the first side panel 22 and the second side panel 23 are respectively positioned parallel with the first side surface 111 and the second side surface 112.

Figure 13:
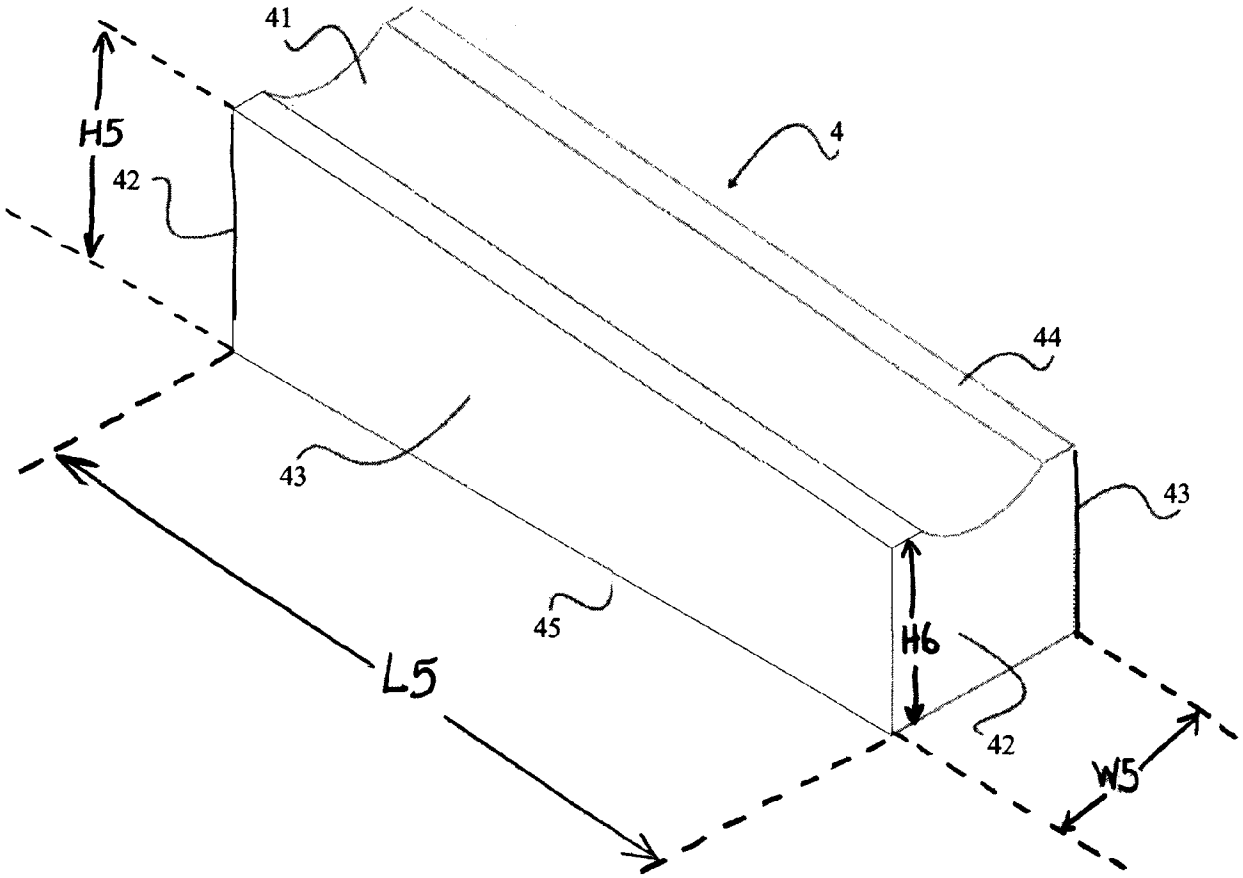
FIG. 13 is a perspective view of the right arm rest.
Figure 14:
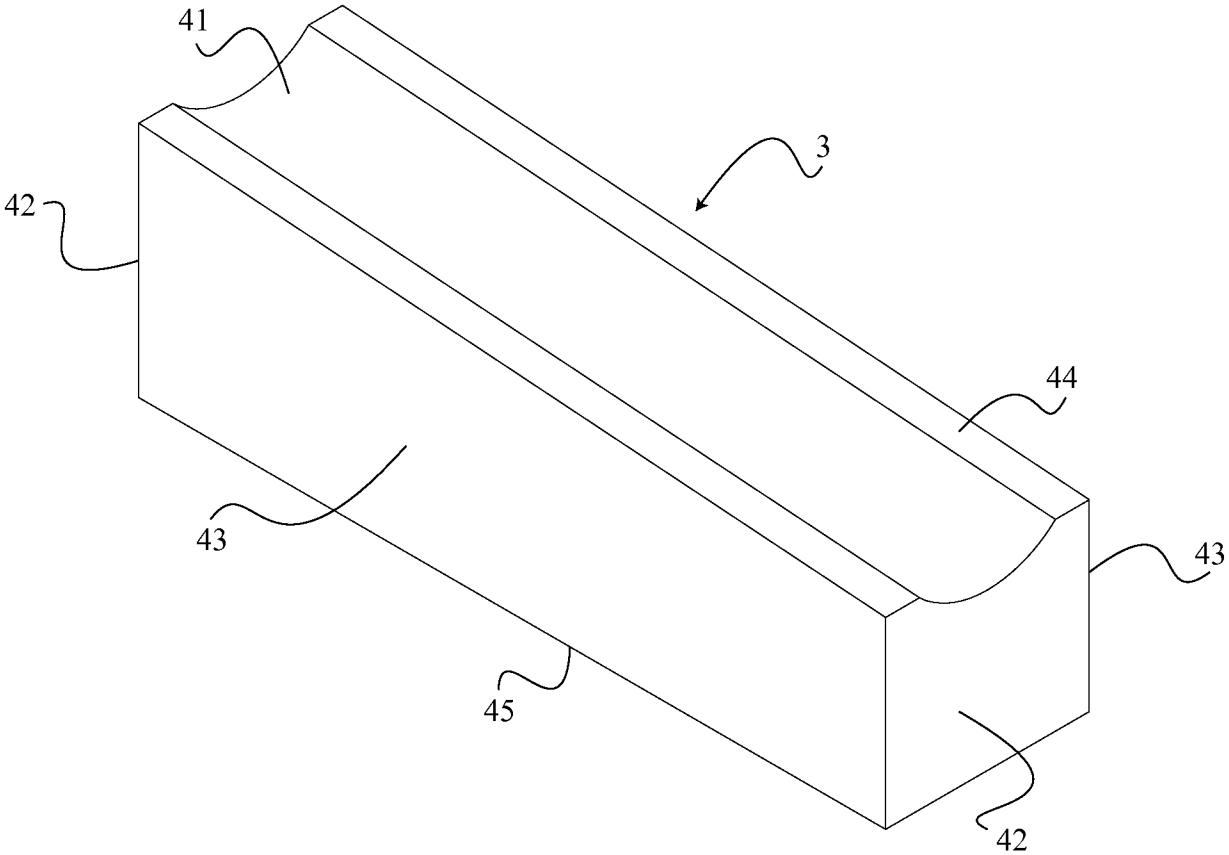
FIG. 14 is a perspective view of the left arm rest.

In reference to FIG. 13 and FIG. 14, the left arm rest 3 and the second arm rest each comprises an arm channel 41, a first pair of sidewalls 42, a second pair of sidewalls 43, a top wall 44, and a bottom wall 45. The first pair of sidewalls 42 is oppositely positioned from each other, and the second pair of sidewalls 43 is also oppositely positioned from each other. The first pair of sidewalls 42 is perpendicularly positioned with the second pair of sidewalls 43. The top wall 44 is positioned above the first pair of sidewalls 42 and the second pair of sidewalls 43, and the bottom wall 45 is positioned below the first pair of sidewalls 42 and the second pair of sidewalls 43. The arm channel 41 has a long shallow concave-shaped surface. The arm channel 41 is centrally positioned on the top wall 44, in between the first pair of sidewalls 42. The left arm rest 3 and the right arm rest 4 have a length L5, a width W5, a height H5, and a height H6. In the preferred embodiments, the length L5 is about 55 centimeters, the W5 is about 15 centimeters, the height H5 is about 17.5 centimeters, and the height H6 is about 13.5 centimeters.

The present invention is made of high quality foam. Although the present invention is made of high quality foam, the present invention can also be made from rubber, plastic, or any other materials. Furthermore, the preferred embodiments have been described with particular dimensions, it is to be understood that the present invention can be configured to have other dimensions suitable for differently structured body types, such as infant, child, teen, or adult.

Figure 9:
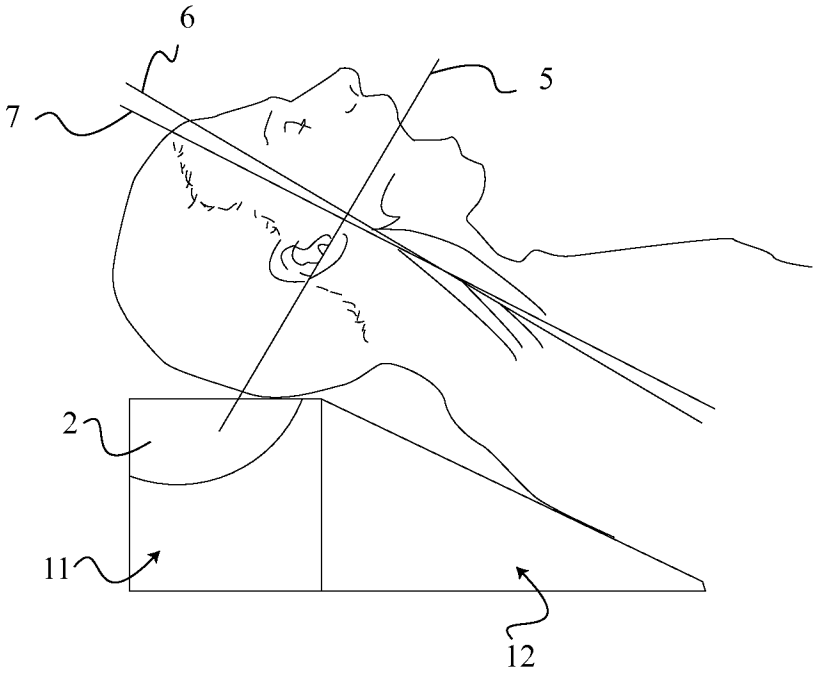
FIG. 9 is a side view of the base section and the upper pad configured to position a patient's head in a normal position.
Figure 10:
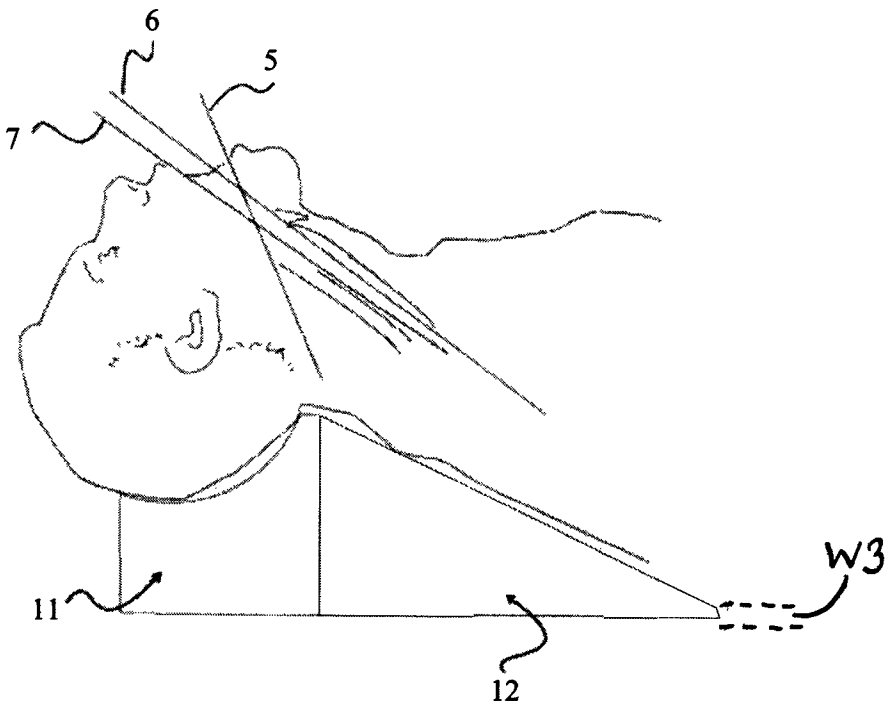
FIG. 10 is a side view of the base section and the upper pad configured to position the patient's head in a sniff position.
Figure 11:
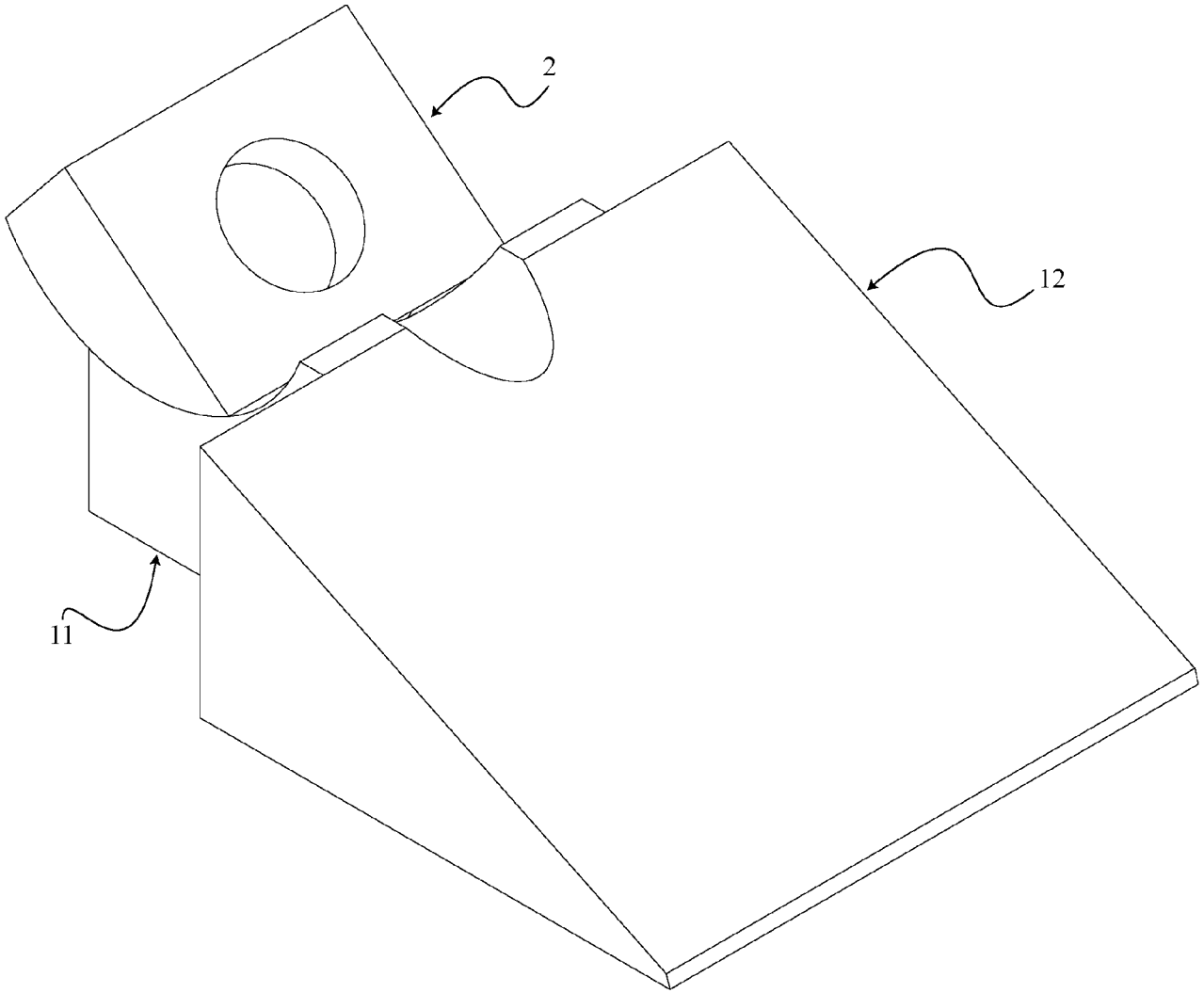
FIG. 11 is a perspective view of the base section and upper pad, where the upper pad is rotated within the head section.
Figure 12:
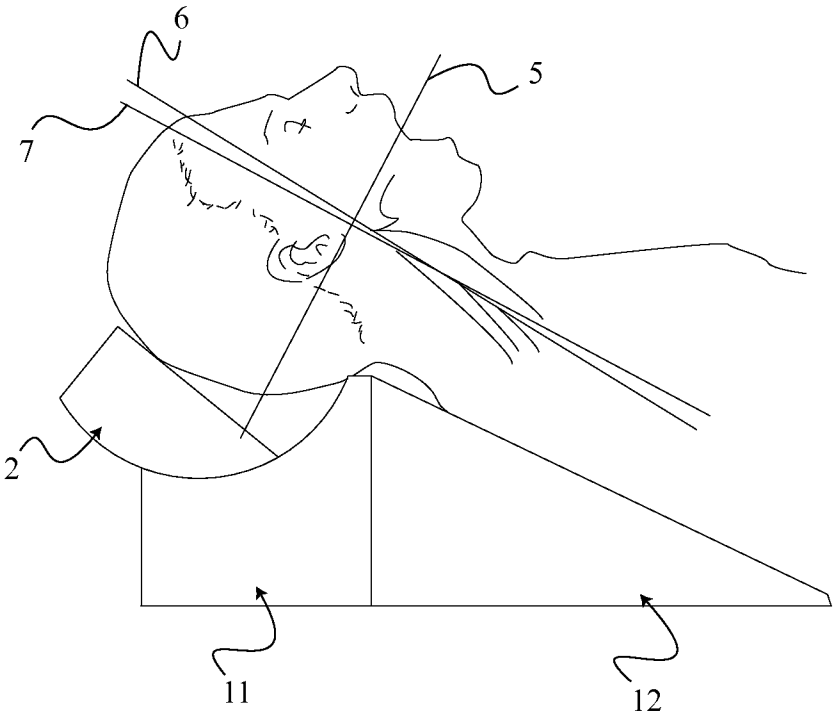
FIG. 12 is a side view of the base section and the rotated upper pad configured to position the patient's head.
Figure 15:
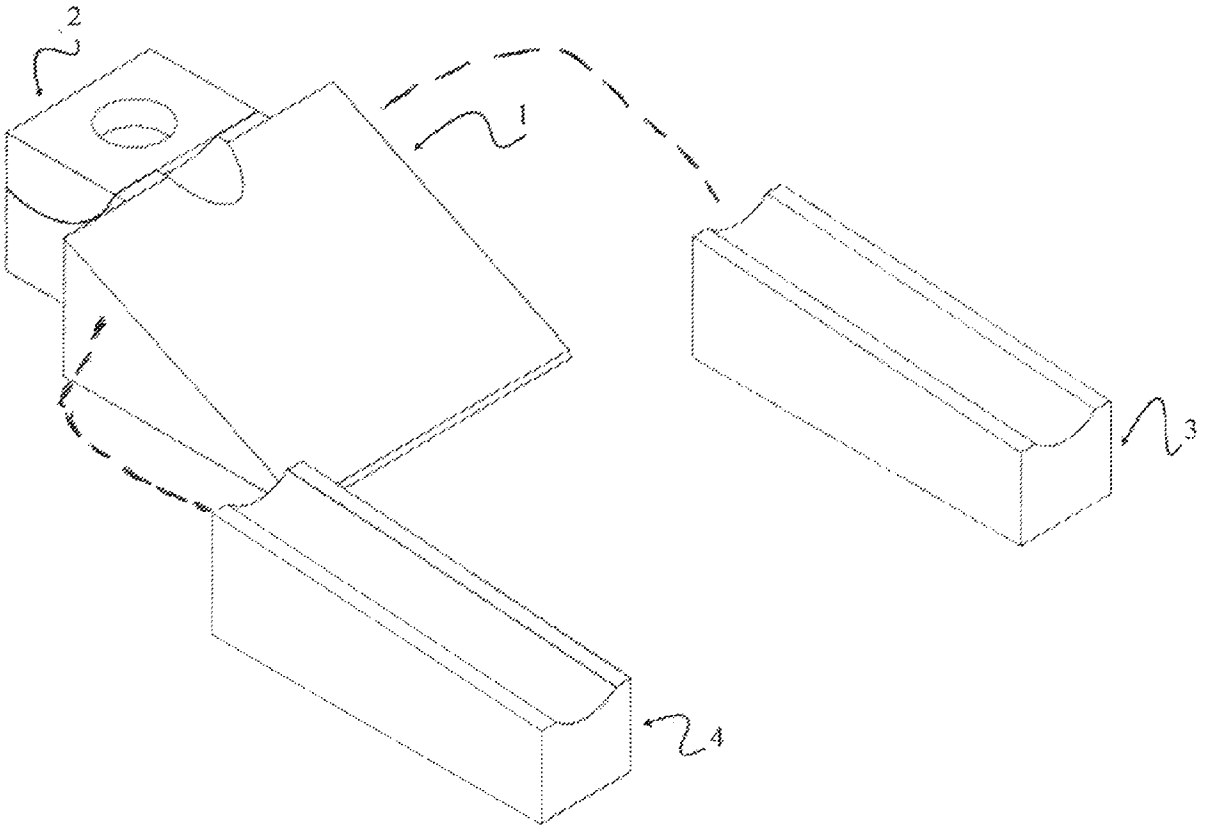
FIG. 15 is a perspective view of the present invention.
Figure 16:
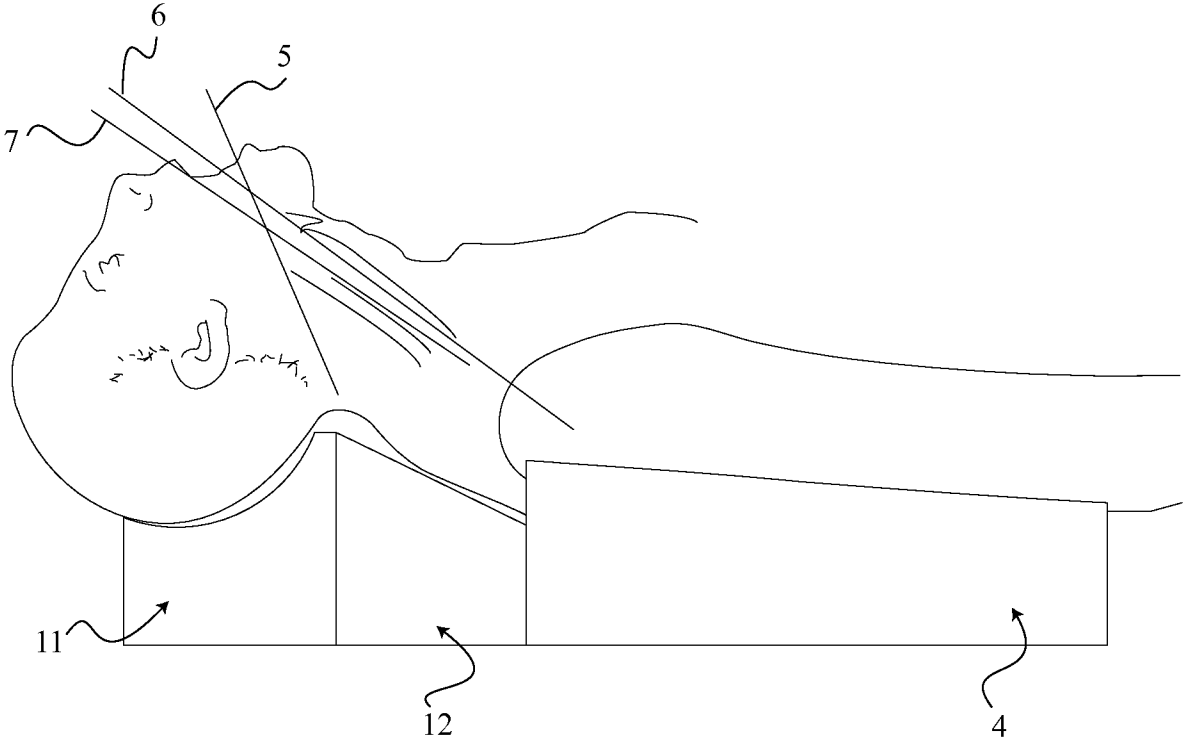
FIG. 16 is a side view of the present invention, without the upper pad, where the base section and the right arm rest are configured to the patient's head and right arm.
Figure 17:
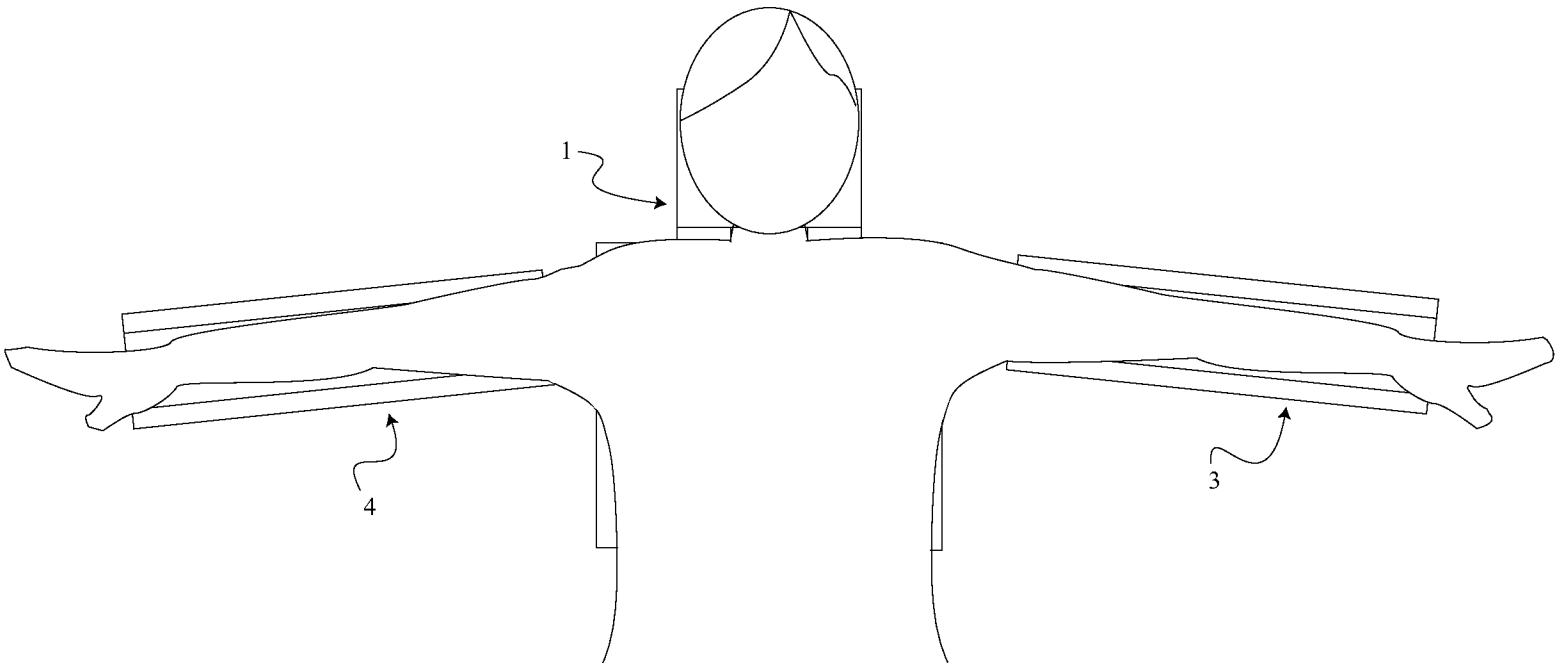
FIG. 17 is a top view of the present invention where the base section, the right arm rest, and left arm rest are respectively configured to the patient's head, right arm, and left arm in a ninety degree abduction position.

In reference to FIG. 9, proper positioning of the base section 1 is accomplished by ensuring the inclined surface 124 under the obese patient's upper and middle back and placing the obese patient's head on the upper pad 2. In reference to FIG. 10, FIG. 11, and FIG. 12, as soon as the obese patient loses consciousness, the upper pad 2 is either removed or rotated down to the desired degree according to patient's neck anatomy or laryngoscopists preference. For example, an obese patient who has an anterior larynx/or stiff neck may need less head extension. In order to compensate the stiff neck, the upper pad 2 may be rotated within the head section 11. Reference to FIG. 10, when the obese patient's head is positioned within the concave surface 114, the present invention aligns the oral axis 5, the pharyngeal axis 6, and the laryngeal axis 7 creating short and straight path between the mouth and the rima glottidis. When the upper pad 2 is removed from the base section 1, the obese patient's head drops down to the concave surface 114 and the head is fully extended to the sniff position. The fully extended sniff position allows the laryngoscopist to clearly see the laryngeal inlet which allows easy and safe intubation. Therefore the injury or damage to the upper airway can be reduced significantly. While the obese patient's head is extended to the sniff position, the inclined surface 124 supports the upper and middle back area. The obese patient's neck and head are completely secured within the base section 1, due to the respective positioning of the indentation 16 and the base cavity 115. The obese patient's neck is positioned within the indentation 16 while the obese patient's head concentrically positions with the base cavity 115. Since the obese patient's neck is supported by the indentation 16, lengthy operations can be carried out. After the intubation has taken place, the upper pad 2 may or may not be inserted into the head section 11. In reference to FIG. 10, since the present invention effectively raises the patient's head and neck in fully stable exposed extension position, the invention facilitates internal jugular vein catheterization; neck surgery such as thyroidectomy or laryngectomy. The present invention also facilitates different type of surgeries on the chest area, such as open heart surgery and breast surgery, as the surgeons may position the operated the obese patients in a sit-upright position. The base section 1 are easily positioned under the obese patient's body. Since the inclined surface 124 only supports the upper and middle back area, the base section 1 can be easily inserted and pulled out. Since the length L1 is always larger than the length L3, two empty spaces are positioned above the back section 12. The two empty spaces allow the anesthesiologists and nurses to place their medical equipments, such as a tracheal tube, syringes of intravenous drugs, or other related equipments, next to the obese patient. In reference to FIG. 15 and FIG. 16, the left arm rest 3 and the right arm rest 4 are respectively placed under the obese patient's left arm and the right arm. The left arm rest 3 is located adjacent with the second side panel 23, and the right arm rest 4 is located adjacent with the first side panel 22. The left arm rest 3 and the right arm rest 4 are essential because of the increased height of the base section 1 ,and the restricted movement of the obese patient's arms. The left arm and the right arm of the obese patient are placed within the arm channel 41, and the left arm rest 3 and the right arm rest 4 can be moved along the left arm and the right arm for proper positioning. The left arm rest 3 and the right arm rest 4 supports the obese patient's arms and the shoulder area. Since the left arm rest 3 and the right arm rest 4 are completely independent from each other, they provide grate range of flexibility to the surgeons. In reference to FIG. 17, the surgeons can move the obese patient's arm to any different abduction position angle, while keeping both arms secured within the left arm rest 3 and the right arm rest 4.

The present invention can also be used in the performance of cardiopulmonary resuscitation (CPR). When the present invention is used during the performance of cardiopulmonary resuscitation, a victim's airway is quickly and effectively opened in a hospital or in an emergency medical service. This allows proper ventilation to the victim and increases the efficiency of the CPR, and the obese patient can be ventilated immediately by any one while waiting for an intubation. The present invention can also be used in postoperative period to prevent airway obstruction as the obese patients recover from general anesthesia. The present invention prevents respiratory arrest due to airway obstruction in the postoperative obese patients who are not totally awake. In addition, the present invention can be used in a lateral position such as in the performance of colonoscopy. When the pillow is used in the lateral position, the slope side of the inclined surface 124 and the obese patient's face are positioned in the same direction.

Although the invention has been explained in relation to its preferred embodiment, it is to be understood that many other possible modifications and variations can be made without departing from the spirit and scope of the invention as hereinafter claimed.

What is claimed is:

1. An apparatus for effectively raising an obese patient's head and neck above the thorax, allowing gravity to move bodily mass away from the obese patient's airway and aligning the obese patient's oral, pharyngeal and laryngeal axes in order to totally open the obese patient's airway to facilitate ventilation and tracheal intubation and prevent airway obstruction during the postoperative period, comprising:

a base section (1) comprising a bottom portion having a bottom surface (15) and an upper portion (12), the upper portion (12) comprising an inclined surface (124) for receiving an upper back of a patient, the base section (1) further comprising a lower, front end having a front surface (123) and an upper, rear end (13) having a vertical rear wall, wherein the lower, front end has a first height and the upper, rear end (13) has a second height that is greater than the first height so as to provide the incline of the inclined surface (124), wherein the height of the base section (1) increases linearly between the lower, front end and the upper, rear end (13), the base section (1) further comprising a pair of sidewalls (121, 122) that are parallel to each other and perpendicular to the vertical rear wall of the upper, rear end (13), the upper portion (12) having an upper, perimetrical boundary at the upper, rear end (13) that extends between the pair of sidewalls (121, 122), the upper portion (12) further comprising a concave portion (16) that (i) bisects the upper, perimetrical boundary, (ii) is centrally located between the pair of sidewalls (121, 122) such that the inclined surface (124) extends between the concave portion (16) and each of the sidewalls (121, 122), and (iii) extends for a distance towards the lower front end of the base section (1), the concave portion (16) comprising a concave surface that is sized and shaped to receive the back portion of an obese patient's neck;

a head section (11) attached to the vertical rear wall of the upper, rear end (13), the head section (11) comprising an upper end that is adjacent to the perimetrical boundary of the upper portion (12) and which has a third height that is equal to the second height of the upper, rear end (13) of base section (1), the head section (11) further comprising a lower end that has a fourth height that is less than the third height and greater than the first height of the lower, front end of the base section (1), the head section (11) further comprising a pair of sidewalls (111, 112) and a rear wall (113), wherein the rear wall (113) and the pair of sidewalls (111, 112) are vertically oriented and the sidewalls (111, 112) are substantially perpendicular to the rear wall (113), the head section (11) further comprising a concave surface (114) that extends between the upper end of the head section (11) and the lower end of the head section (11) for receiving the back of an obese patient's head, wherein the concave portion (16) extends beyond the perimetrical boundary of upper portion (12) of base section (1) and the upper end of the head section (11) such that the concave portion (16) is adjacent to the concave surface (114), the head section (11) further comprising a cavity (115) that is centrally located in the concave surface (114) and is substantially aligned with concave portion (16), the cavity (115) having a diameter D1 that allows the occiput of a patient's head to be positioned within the cavity (115), the base section (1) having a first width measured from sidewall to sidewall and the head section (11) has a second width measured from the sidewall to the sidewall, wherein the first width is greater than the second width, wherein when the back of an obese patient's head is positioned on the concave surface (114) and the occiput of the obese patient's head is positioned in the cavity (115), the concave surface (114) and the diameter D1 of the cavity (115) cooperate to fully extend the obese patient's head at the Atlanto-occipital joint so that the oral axis (5), pharyngeal axis (6) and laryngeal axis (7) of the obese patient are substantially aligned thereby creating a short and straight path between the obese patient's mouth and rima glottidis;

a pad member (2) configured to be removably and adjustably positioned upon the concave surface (114) and comprising a top side (21), a pair of sidewalls (22, 23) and a curved bottom side (25) that contacts the concave surface (114), wherein the curved bottom side (25) has a curvature that corresponds to the curvature of the concave surface (114), the top side (21) having a centrally located cavity (26) for receiving the occiput of a patient's head, the centrally located cavity (26) having a diameter D2 that is equal to the diameter D1 of cavity (115), wherein the position of the pad member (2) upon the concave surface (114) is rotatable downward to a desired degree in accordance with the patient's neck anatomy or requirements by medical personnel;

whereby when the pad member (2) is positioned on the concave surface (114) and the obese patient's head is positioned on top side (21), the pad member (2) cooperates with the base section (1) to allow the obese patient's head and neck to be elevated above the obese patient's thorax and abdomen, and wherein the pad member (2) and the inclined surface (124) cooperate to allow gravity to cause a shifting of bodily mass away from the obese patient's airway;

whereby when pad member (2) is removed from head section (11), the obese patient's neck is positioned within concave portion (16) while the obese patient's head concentrically positions within base cavity (115) such that the obese patient's neck and head are completely secured on base section (1) in order to facilitate intubation of the obese patient; and a pair of inclined arm rests (3, 4) that are separate from the base section (1) and head section (11) such that the arm rests (3, 4) may be moved to different angular positions with respect to the base section (1) and head section (11), wherein each arm rest (3, 4) is located on a corresponding side of the base section (1), each arm rest (3, 4) comprising a relatively shallow concave arm channel (41) for receiving an arm of the obese patient, a first pair of sidewalls (42), a second pair of sidewalls (43), a top surface (44), a bottom surface (45) and a first end having a fifth height and a second end that has a sixth height that is less than the fifth height so as to provide an incline in each arm rest (3, 4), wherein each arm channel (41) is centrally positioned in top surface (44) between the second pair of sidewalls (43), wherein the first end of each arm rest (3,4) is positioned in proximity to the base section (1) so that the obese patient's hand is in proximity to the second end having the sixth height.

* * * * *